US005613256A

United States Patent [19]

Hanson

[11] Patent Number: 5,613,256

[45] Date of Patent: Mar. 25, 1997

[54] ADJUSTABLE WHEELCHAIR SEAT CUSHION SYSTEM

[76] Inventor: Chris A. Hanson, 4563 S. Meadow Dr., Boulder, Colo. 80301

[21] Appl. No.: 557,924

[22] Filed: Nov. 14, 1995

[51] Int. Cl.[6] ..... A47C 7/14; A47C 27/18

[52] U.S. Cl. ..... 5/653; 5/654; 5/922; 297/284.9; 297/452.26; 297/DIG. 6

[58] Field of Search ..... 5/653, 654, 652, 5/640, 922, 465; 297/284.9, DIG. 6, 452.26

[56] References Cited

U.S. PATENT DOCUMENTS

| | | | |
|---|---|---|---|
| 2,156,629 | 5/1939 | Hutchison | 155/182 |
| 2,260,437 | 10/1941 | Chambers | 155/182 |
| 3,308,491 | 3/1967 | Spence | 5/348 |
| 3,503,649 | 3/1970 | Johnson | 297/459 |
| 3,568,225 | 3/1971 | Radke | 297/452.26 |
| 3,787,908 | 1/1974 | Beck et al. | 5/348 |
| 3,987,507 | 10/1976 | Hall | 5/338 |
| 4,370,769 | 2/1983 | Herzig et al. | 5/452 |
| 4,588,229 | 5/1986 | Jay | 297/459 |
| 4,643,481 | 2/1987 | Saloff et al. | 297/458 |
| 4,655,505 | 4/1987 | Kashiwamura et al. | 297/284 |
| 4,670,925 | 6/1987 | Carussi | 5/481 |
| 4,726,086 | 2/1988 | McEvoy | 5/464 |
| 4,726,624 | 2/1988 | Jay | 297/459 |
| 4,912,788 | 4/1990 | Lonardo | 5/432 |
| 5,018,790 | 5/1991 | Jay | 297/458 |
| 5,088,747 | 2/1992 | Morrison et al. | 297/219 |
| 5,189,747 | 3/1993 | Mundy et al. | 5/654 |
| 5,333,921 | 8/1994 | Dinsmoor, III | 297/219.1 |
| 5,343,876 | 9/1994 | Rogers | 128/870 |
| 5,370,444 | 12/1994 | Stulik | 5/653 |
| 5,378,045 | 1/1995 | Siekman et al. | 5/654 |

FOREIGN PATENT DOCUMENTS

| | | | |
|---|---|---|---|
| 925168 | 2/1970 | Switzerland | 5/922 |
| 1541071 | 2/1979 | United Kingdom | 5/909 |
| 2113990 | 8/1983 | United Kingdom | 5/653 |

*Primary Examiner*—Alexander Grosz
*Attorney, Agent, or Firm*—Sheridan Ross P.C.

[57] ABSTRACT

An adjustable seat cushion system which is particularly suited for wheelchair applications is disclosed (e.g., used over a conventional wheelchair seat). The system generally includes a central cushion assembly which includes a base with a pad positioned thereon. One generally elongated side cushion is disposed on each of the two sides of the central cushion assembly and is movably interconnected with the central cushion assembly. The position of each of the side cushions may be adjusted relative to the central cushion assembly and be substantially retained within the adjusted position. Changing the position of the side cushions may be utilized to adapt the seat cushion system to the anatomical characteristics of a variety of different users and/or to provide different support objectives.

24 Claims, 15 Drawing Sheets

ADJUSTABLE WHEELCHAIR SEAT CUSHION SYSTEM

FIELD OF THE INVENTION

The present invention generally relates to the field of seat cushion systems (e.g., for wheelchair applications) and, more particularly, to seat cushion systems which are adjustable to the anatomical structure of the user and/or to achieve certain support-related objectives.

BACKGROUND OF THE INVENTION

A variety of wheelchair seat cushion systems which include a tray or a base structure and a cushion positioned thereon have been proposed. Although many of these systems have realized significant commercial success, generally they suffer from a number of user-related drawbacks. Initially, many existing systems are relatively heavy. This increased weight is particularly disadvantageous to the user when exiting the wheelchair and collapsing the same for transport (e.g., when entering an automobile), which obviously requires removal of the wheelchair seat cushion system for storage. A significant portion of the weight of these systems is the fluid-filled cushion which is utilized since the corresponding tray is not appropriately anatomically conforming to the user. As such, designers/manufacturers have used an overabundance of fluid for the cushion to compensate for this non-conformance.

The design of the wheelchair seat cushion system can also have an effect on user comfort. For instance, heat and moisture are inevitably generated through use of the system. In the event that the system is not effective in dissipating heat and/or moisture, user discomfort and the risk of bed sores can result. Moreover, the shape of the wheelchair seat cushion system has a significant effect on user comfort. As an example, in many systems there have been significant problems with hammocking which adversely affects user comfort. Hammocking is a condition which occurs when the user is in effect being supported by the upper ply of the cushion versus the fluid therein and which is due to inadequacies in the design of the system.

The shape of the system also affects the distribution of the forces of the user's weight over the system. If force distribution is relatively poor, which equates with high or concentrated pressures, the user is susceptible to pressure sores. As such, maximization of the interfacing area between the user and the wheelchair seat cushion system is desirable. Moreover, the existence of significant shear-like forces between the user and the system can of course also contribute to patient discomfort.

Based upon the foregoing, there is a continuing need for a wheelchair seat cushion system which addresses user maneuverability and comfort issues to a greater and more effective extent than existing systems.

SUMMARY OF THE INVENTION

The present invention generally relates to an adjustable seat cushion system which is particularly suited for wheelchair user support applications. The seat cushion system may be used with a rigid wheelchair seat or a sling-type configuration.

In one embodiment, the seat cushion system of the present invention includes a central cushion assembly and an elongated side cushion (e.g., generally tubular) associated with each of the two laterally spaced sides of the central cushion assembly (e.g., having a length substantially equal to that of the associated side of the central cushion assembly). Structure is provided for adjusting at least a lateral position of the two side cushions and for substantially retaining the side cushions in the "adjusted" position. Preferably, the position of the two side cushions are independently adjustable.

Further features may be included in the above-described embodiment. Each of these features are to be considered as usable in the noted embodiment independently of each other unless otherwise noted. The central cushion assembly may include a support base (e.g., foam) with a padding assembly disposed over an upper surface of this base. Increased versatility (e.g., to allow various characteristics of the system to be adapted to the needs/desires of the user) of the seat cushion system may be provided by a modular construction. In this regard, a cover assembly may be utilized in which there is a corresponding compartment for removably receiving/retaining the base such that the base may be removed and reinserted/replaced as necessary. This then allows the user to select from a variety of bases (e.g., bases may be offered having different upper surface contours and/or different degrees of compressibility). The padding assembly could also be disposed within an appropriate compartment of the cover assembly. The entire padding assembly or at least portions thereof may be fixably retained within the cover assembly.

An upper surface of the base may be anatomically contoured, such as by including a generally concave, ovally-shaped, laterally disposed depression (i.e., such that the primary axis of the ovally-shaped depression extends laterally across the seat cushion system) in the aft or rearward portion of the base. The bottom of this depression may actually extend completely through the entire thickness of the base. This type of depression provides for a desirable interface with the user's buttocks region and specifically including the user's ischial tuberosities and trochanters. Another anatomically-related feature which may be used alone or in combination with the above-noted depression is a pair of base leg depressions in the forward portion of the base for interfacing with the user's legs. These depressions would be laterally spaced and would primarily extend in a fore-aft orientation (e.g., the primary axis of the leg depressions may also extend toward or away from the side of the base to a degree proceeding fore-to-aft).

The above-noted padding assembly may include multiple types of padding materials. For instance, the forward portion of the padding assembly may utilize a solid, compressible foam structure while the rearward portion may utilize an appropriate fluid (e.g., a flowable material such as a material which is relatively viscous, resists flowing in response to instantaneously applied pressure, but flows in response to continuously applied pressure). When the base includes a depression in the rearward portion thereof, the portion of the padding device disposed within this depression is preferably liquid-based (e.g., a flowable material as set forth above) to alleviate the need for a "perfect" interface between the base and the user's buttocks region. Laterally spaced areas having no liquid therein may be provided in the rearward portion of the padding device to generally coincide with a user's ischial tuberosities when positioned on the seat cushion system. When the base includes the above-noted leg depressions and when a forward portion of the padding device is a solid, compressible pad, preferably this solid, compressible pad is also anatomically shaped to desirably interface with the user's legs by also including a pair of leg depressions.

Each of the above-noted side cushions may utilize multiple foam layers (e.g., a first foam layer of a first durometer rating and a second foam layer, disposed on said first foam layer with a second durometer rating). An upper foam layer which interfaces with the user may be "softer" than a lower foam layer which interfaces with the structure which supports the seat cushion system (e.g., a wheelchair seat). These side cushion assemblies may also be contoured to direct the user toward a more "interior" portion of the seat cushion system or to provide a degree of "side-to-side" stability." One configuration of a side cushion which provides this objective is a generally wedge-shaped structure which increases in thickness progressing away from the central, longitudinal axis of the seat cushion system. Another such configuration is a generally teardrop-shaped structure in lateral cross-section (e.g., a lateral cross-section taken perpendicularly to the longitudinal extent of the side cushion assembly has a teardrop-shaped profile). As noted above, increased versatility (e.g., to allow various characteristics of the system to be adapted to the needs/desires of the user) of the seat cushion system may be provided by a modular construction. A cover assembly may be utilized in which there is a corresponding compartment for removably receiving/retaining each of the side cushions such that each of the side cushions may be separately removed and reinserted/replaced as necessary. This then allows the user to select from a variety of side cushions (e.g., side cushion assemblies may be offered having different upper surface contours and/or different degrees of compressibility). A cover assembly which includes compartments for at least portions of the central cushion assembly and the side cushions offers yet further enhanced versatility.

Adjustment of the position of each of the side cushions relative to the central cushion assembly may be provided by having the side cushions detachably interconnected with the central cushion assembly. However, preferably this adjustment is provided by having at least one side cushion positioner extend at least laterally from the associated side cushion into engagement with a lower surface of the central cushion assembly. Disposing the side cushion positioner at a variety of angles changes the position of the associated side cushion relative to the central cushion assembly. Each of these positioners may include a substantially rigid member which substantially retains the side cushions in the desired position relative to the central cushion assembly. Velcro® or other appropriate fasteners may be utilized to physically interconnect each of the noted positioners and the lower surface of the central cushion assembly in the desired position.

The above-noted seat cushion system may also include structure for movably interconnecting each of the side cushions with the central cushion assembly such that the position of each of the side cushions may be adjusted while maintaining the interconnection between the associated side cushion and the central cushion assembly. This may be provided by utilizing at least one flexible connector between each of the side cushions and the central cushion assembly.

One embodiment which utilizes/provides support for a variety of the above-noted features is a seat cushion system which includes a cover assembly (e.g., a thin, flexible, pliable, and liquid impervious material). This cover assembly includes a central section having at least one central compartment. A side compartment is flexibly interconnected with each of the two laterally spaced sides of the central section (e.g., by one or more tabs, by sheet of pliable material).

The seat cushion system further includes a central cushion assembly having a support base removably disposed in the noted central compartment of the central section of the cover assembly. A padding assembly of the central cushion assembly is disposed over the support base. All or portions of the padding assembly may be fixably retained within the central section of the cover assembly. Conversely, all or portions of the padding assembly may likewise be removably retained within a compartment of the central section of the cover assembly.

At least one side cushion is removably received in each of the two side compartments of the cover assembly. A side cushion positioning member, separate from or in addition to the noted flexible interconnection between the central section of the cover assembly and the side compartments, extends from each of the side compartments and detachably engages a lower surface of the central section of the cover assembly. Preferably, at least a portion of this positioning member extends below and is interconnected with the lower surface of the side compartment containing the side cushion. By varying the position of each of the positioning members relative to the central section of the cover assembly, the position of the associated such cushion relative to the central cushion assembly is likewise modified.

DETAILED DESCRIPTION

The present invention will be described in relation to the accompanying drawings which assist in illustrating various pertinent features of the present invention. Although the present invention may be used in a variety of applications, it is particularly useful for use on wheelchair seats (e.g., rigid, sling-type). The present invention will be described with regard to this wheelchair seat application.

Figure 1:
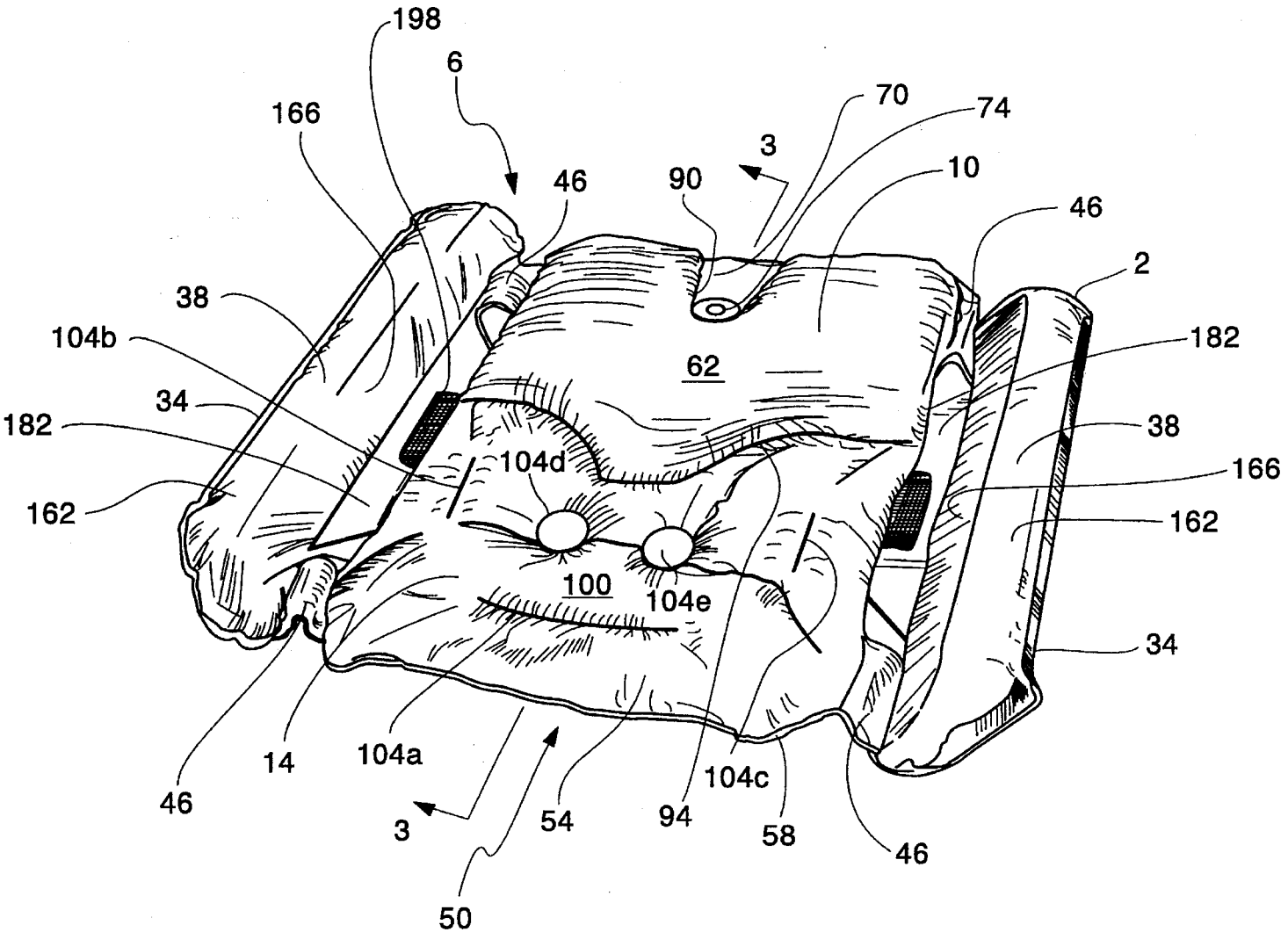
FIG. 1 is a perspective view of one embodiment of a seat cushion system in accordance with principles of the present invention.

A seat cushion system 2 is illustrated in FIG. 1 and generally includes a central cushion assembly 50 and a pair of side cushions 162, all of which are incorporated into a cover assembly 6. The cover assembly 6 is illustrated in FIGS. 1–4B and has a central section 10 for the central cushion assembly 50 and a pair of side sections 34 for the two side cushions 162. At least one and in the illustrated embodiment a pair of flexible connectors 46 interconnect each of the side sections 34 of the cover assembly 6 with the central section 10 of the cover assembly 6, and therefore the side cushions 162 with the central cushion assembly 50. This allows for the positioning of each of the side sections 34 of the cover assembly 6, and thereby the associated side cushion 162, to be adjusted relative to the central section 10 of the cover assembly 6 and thus the central cushion assembly 50 in a manner discussed in more detail below. The desired flexible interconnection could also be provided by a sheet of flexible material which extends between the central section 10 of the cover assembly 6 and each of the side sections 34 of the cover assembly 6 along a substantial portion of their respective lengths (not shown).

Figure 3A:
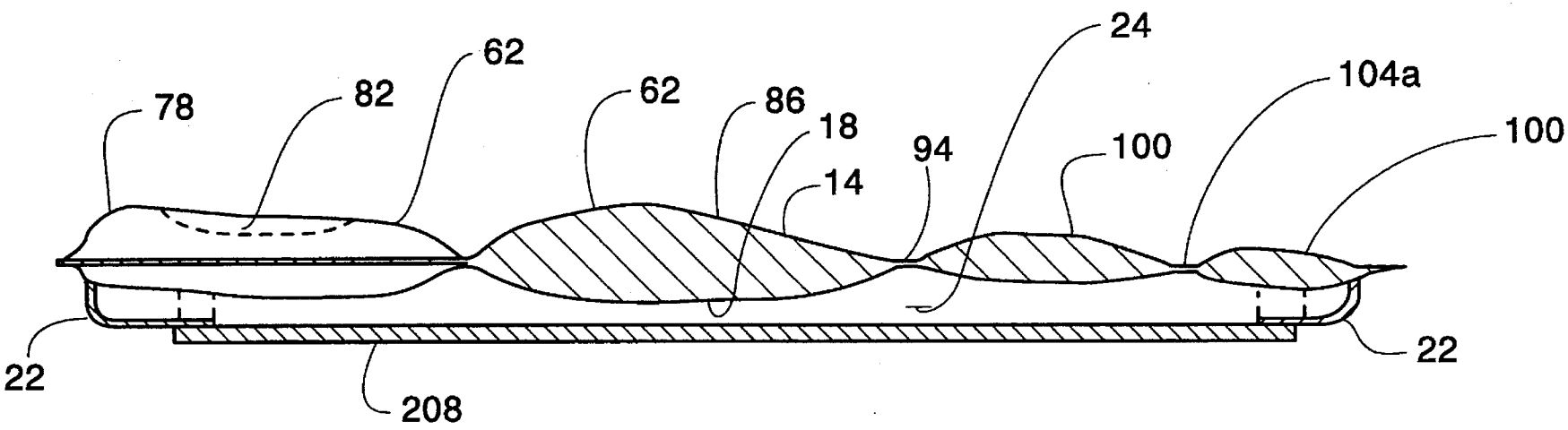
FIG. 3A is cross-sectional view taken along line 3—3 of FIG. 1.
Figure 5:
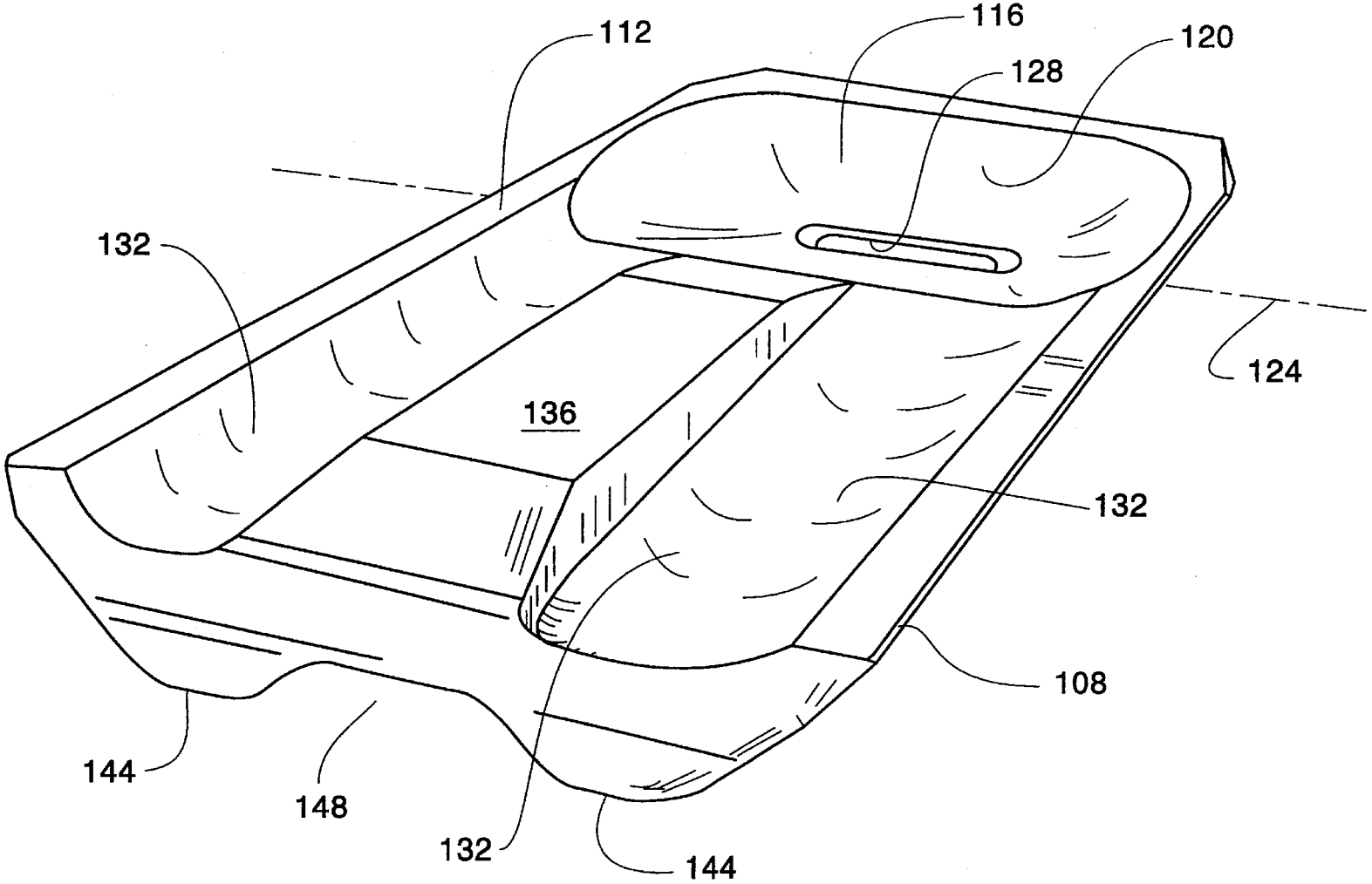
FIG. 5 is one perspective view of the base of the central cushion assembly from the seat cushion system of FIG. 1.
Figure 6:
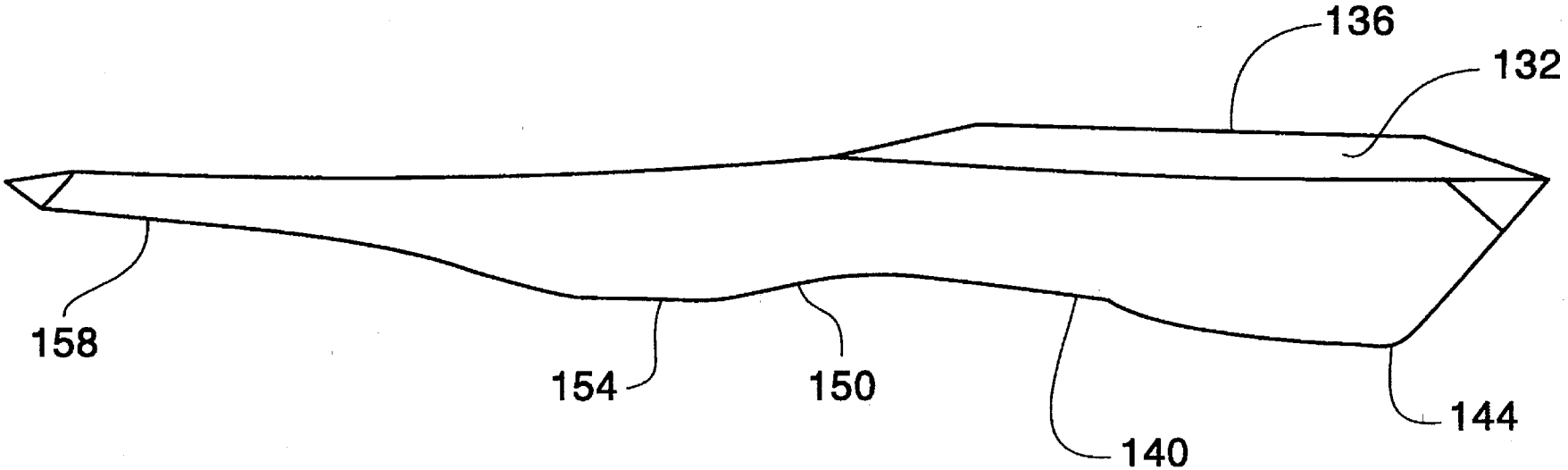
FIG. 6 is a side view of the base of FIG. 5.
Figure 7:
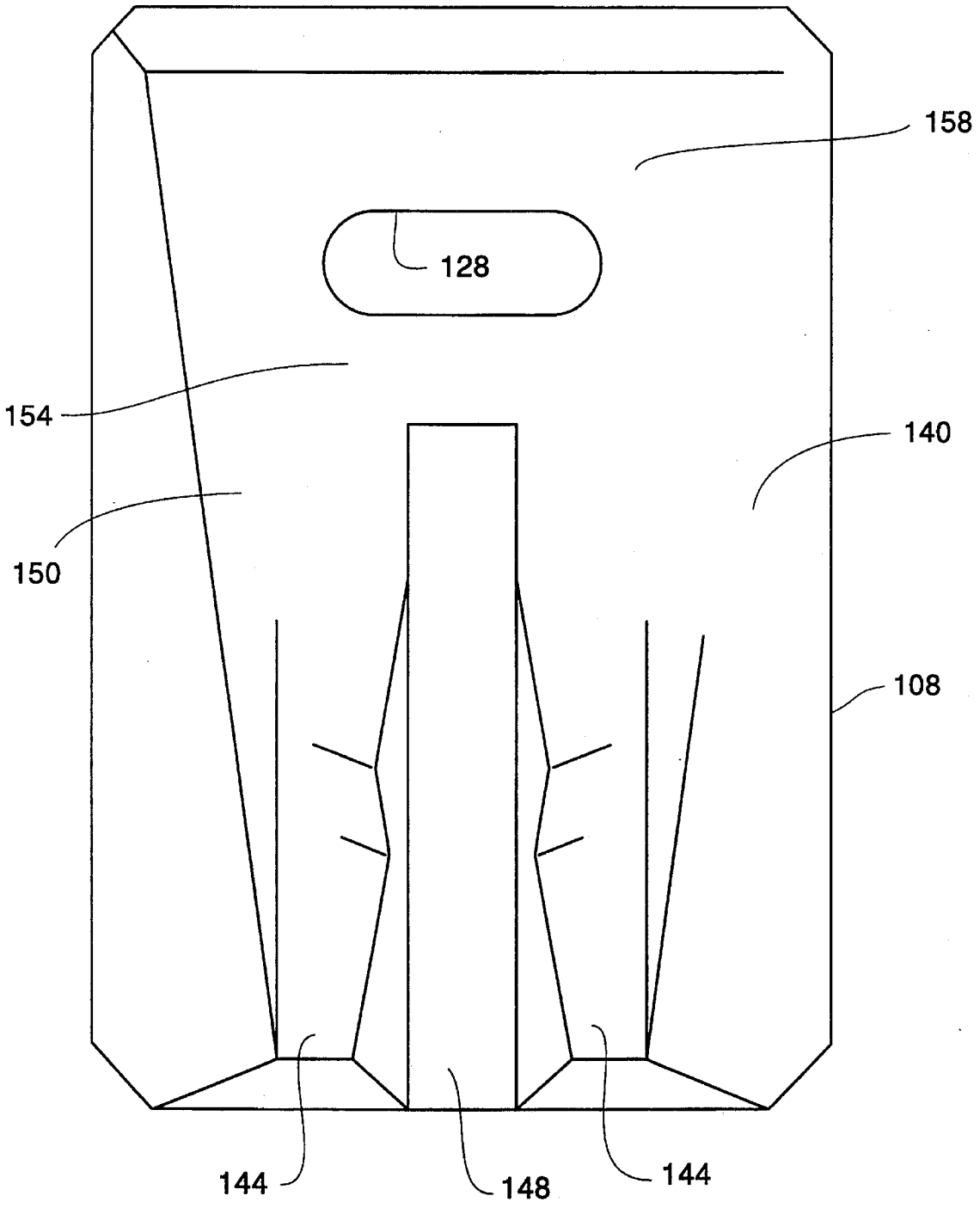
FIG. 7 is a bottom view of the base of FIG. 4.

The central cushion assembly 50 has a base 108 (e.g., FIGS. 5–7) with a padding assembly 54 disposed on the base 108 (e.g., FIGS. 1 and 3A). Generally, the base 108 may be viewed as the primary support for the seat cushion system 2, and is therefore of sufficient rigidity to provide this function. However, preferably the base 108 is also somewhat flexible so as to be able to flex or deflect in certain, preferably predetermined manners (e.g,. to provide a desired interface with the user and/or meet certain support objectives). Furthermore, preferably the base 108 is of relatively light weight. Various types of foam will meet these objectives for the base 108.

An upper surface 112 of the base 108 is anatomically-shaped for providing a desirable interface with the user. In this regard, the base 108 includes a rear depression 116. This depression 116 is generally concave, defined by a generally ovally-shaped sidewall 120 which is laterally disposed, and has a laterally extending slot 128 disposed on its bottom which extends entirely through the base 108 and generally coincides with the location of the user's ischial tuberosities. "Laterally" in the context used herein means "side-to-side" or in a side-to-side direction. The primary axis 124 of this ovally-shaped, concave depression 116 thereby extends generally laterally. "Longitudinally", on the other hand, means from a generally forward location to a rearward location, or an axis substantially perpendicular to the primary axis 124.

Two laterally spaced base leg depressions 132 are disposed forward of the rear depression 116 and are generally contoured to receive a user's legs. Disposed between the two base leg depressions 132 is a leg separator 136 which is raised (e.g. at a higher elevation than the base leg depressions 132) and thereby biases the user's legs into the base leg depressions 132. Generally, the side profile of the base 108 may be characterized as wedge-shaped in that the thickness of the base 108 is reduced progressing from its forward portion toward its rear. This disposes the user's buttocks at a lower elevation than the user's legs.

The lower surface 140 of the base 108 interfaces with the wheelchair seat. Generally convexly-shaped support rails 144 are disposed on the forward portion of the base 108, support the base 108 at two discrete, laterally displaced locations, extend generally longitudinally, and are generally disposed below a corresponding base leg depression 132. A lower cavity or central channel 148 separates the rails 144 and is disposed generally below the leg separator 136.

A second region of engagement between the base 108 and the wheelchair seat is a second surface 154 which extends generally laterally and which is displaced rearwardly of the support rails 144. The second surface 154 is located just forward of the slot 128 in the base 108. Disposed between the support rails 144 and the second surface 154 is a first surface 150 which, when a user is not seated on the system 2, is spaced from the wheelchair seat. The first surface 150 is a generally concave or dished-out surface. A third surface 158 is disposed rearwardly of the second surface and generally extends up away from the wheelchair seat when a user is not seated on the system 2. As such, in an "unloaded" state, there will also be a space between the third surface 158 and the wheelchair seat. However, with a user on the system 2, the base 108 will deflect to provide regions of engagement between the lower surface 140 of the base 108 and the wheelchair seat in addition to the support rails 144 and the second surface 154.

The base 108 is preferably removably received/retained by the cover assembly 6 such that the base 108 may be removed from the cover assembly 6 and reinstalled or replaced. In the illustrated embodiment, the cover assembly 6 is formed from a substantially flexible/pliable material and at least portions thereof (but preferably all) are generally impervious to liquids for purposes discussed below. Appropriate materials for the cover assembly 6 include various thermoplastic resinous sheets. Heat sealing or radio frequency welding ("RF welding") may then be used to seal two or more layers of these types of materials together in a desired configuration for the cover assembly 6.

Figure 2:
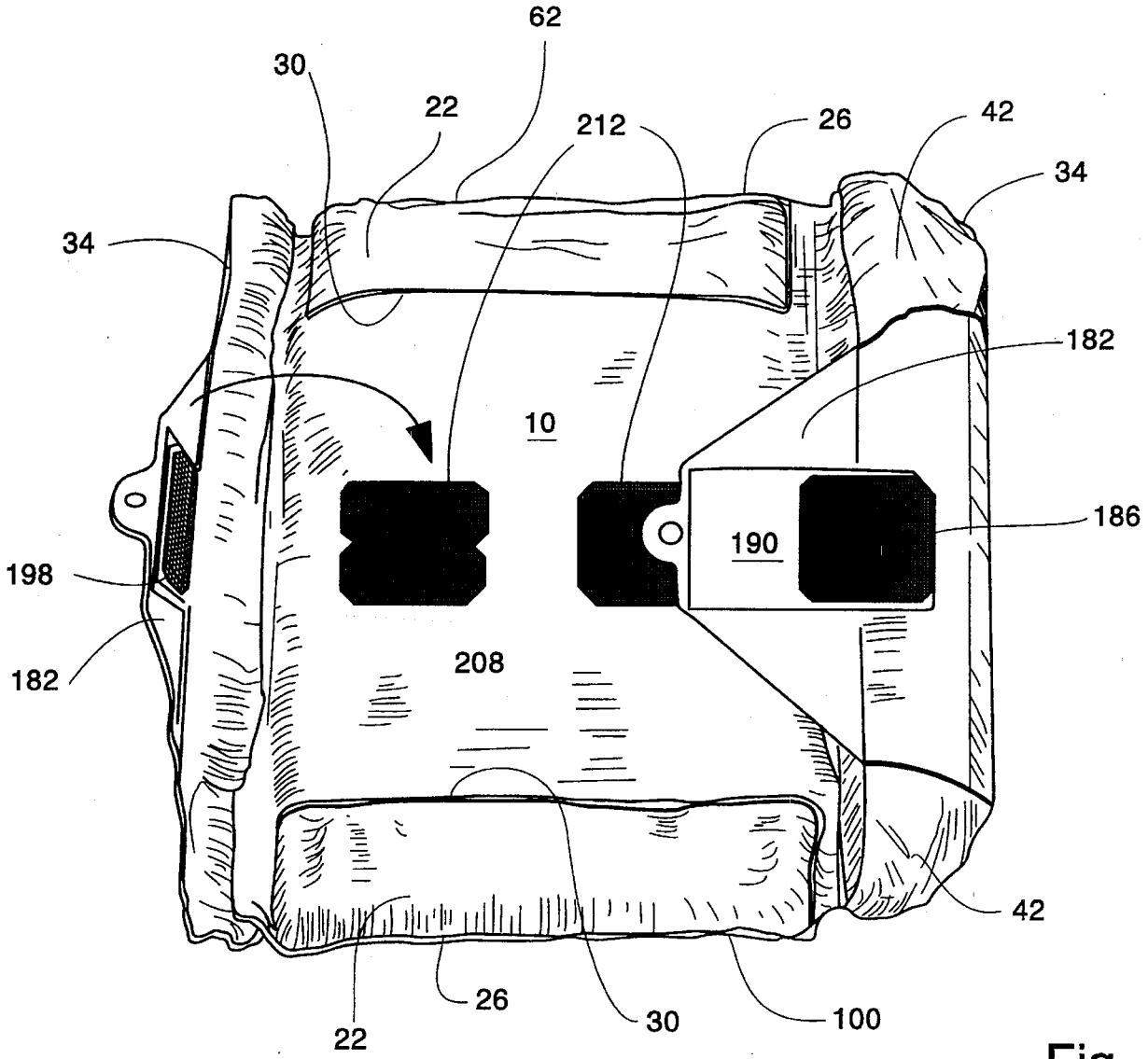
FIG. 2 is a bottom view of the seat cushion system of FIG. 1 with one of the side cushions rotated away.
Figure 3B:
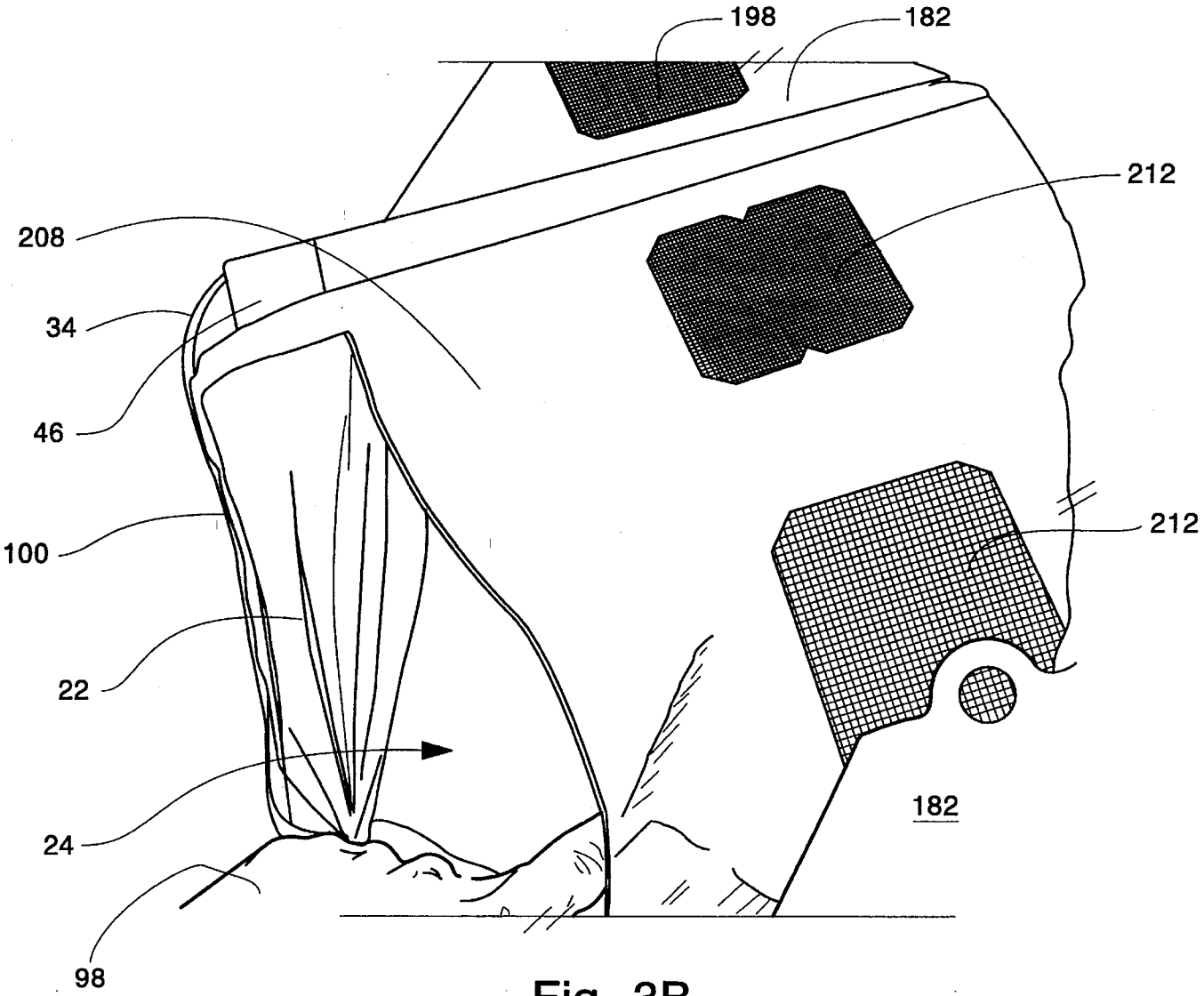
FIG. 3B is a perspective view of the bottom of the seat cushion system of FIG. 1 illustrating the compartment for the base and how the same may be installed.

A central compartment 24 is, formed in a lower portion of the cover assembly 6 by a pair of generally laterally disposed and longitudinally spaced central flaps 22 (e.g., FIGS. 2, 3A, 3B. Preferably, the central flaps 22 are formed from a flexible/pliable material and, in order to assist in installing the base 108, it may even be desirable for these central flaps 22 to also have a degree of elasticity. Moreover, preferably the central flaps 22 are also formed from a heat sealable and/or RF weldable material such that these processes may be used to form the cover assembly 6. In the illustrated embodiment, the central flaps 22 are each attached with a central second layer 18 of the cover assembly 6 along a generally U-shaped central flap seal 26 by heat sealing and/or RF welding (e.g., FIG. 4A). The seal 26 is actually part of the perimeter seal 58 for the padding assembly 54 to be discussed below. Note that the seals 26 do not extend along the edge 30 of the central flaps 22 so as to define an opening for removably receiving/retaining the forwardmost and rearwardmost end portions of the base 108 between the central flaps 22 and the second central layer 18 of the cover assembly 6 (e.g., FIGS. 3A, 3B and 4A). A hand 98 may be used to pull the central flap 22 away for installation of the base 108 and to pull the central flap over the associated end of the base 108.

A third central layer 208 also forms a portion of the compartment 24 which retains the base 108 within the cover assembly 6 (e.g., FIGS. 3A and 3B). This third central layer 208 may be formed from a thicker, more rigid material than the second central layer 18 and the central flaps 22, but yet the third central layer 208 is still preferably flexible. The main body 206 of the third central layer 208, which is disposed over and encloses the base 108, overlaps with at least a portion of the central flaps 22. However, again the central third layer 208 and including the main body 206 is sufficiently flexible so as to be pulled away from the central flaps 22 and the second central layer 18 when positioning the forward and rearward ends of the base 108 between the central flaps 22 and the second layer 8, and when positioning the base 108 between the third central layer 208 and the second central layer 18. This is illustrated in FIG. 3B where a hand 98 is used to provide an opening in the cover assembly 6 for installing the base 108.

The lower surface of the third central layer 208 also includes a pair of positioner Velcro® connectors 212 for interfacing with the side cushion positioners 182. Generally, the side cushion positioners 182 maintain each of the side cushions 162 in a certain position relative to the central cushion assembly 50 and also allow the spacing between the side cushions 162, and thus the width of the seat cushion system 2, to be adjusted. Movement of a side cushion positioner 182 and attaching the same to the associated positioner Velcro® connector 212 changes the position of the associated side cushion 162 and substantially retains such side cushion 162 in this position. A scale 216 (FIG. 4A) may be provided on the lower surface of the third central layer 208 to facilitate adjustment of the positioning of the side cushion positioners,182 and thus the position of the associated side cushion 162.

The central cushion assembly 50 further includes a padding assembly 54 which is disposed on the above-discussed base 108 of the assembly 50 (e.g., FIGS. 1 and 3A). Two padding structures are incorporated into the padding assembly 38—a forward pad 62 and a rear pad 100. Each of these pads 62 and 100 are retained within the cover assembly 6. The forward pad 62 is disposed on the forward portion of the base 108 to interface with the user's legs. Compressible solid materials, such as foam, are utilized as the padding material for the forward pad 46 (e.g., to reduce weight). The forward pad 62 may then be characterized as a solid-based pad.

The forward pad 62 is constructed of two generally fore-aft extending, laterally spaced forward legs 78 and a centrally disposed rear leg 86 which extends rearwardly of the forward legs 78 and generally downwardly. The forward pad 62 may then be characterized as generally Y-shaped in a plan view and looking forward. A pair of generally fore-aft extending, laterally displaced pad leg depressions 82 (one shown in FIG. 3A) are formed in the forward legs 78 of the forward pad 62. The forward portion of the rear leg 86 "leads" to the rear depression 116 in the base 108, while the rearward portion of the rear leg 86 is actually disposed in the rear depression 116 and engages a forward portion of the ovally-shaped sidewall 120.

In the illustrated embodiment, the forward pad 62 is fixably retained within the cover assembly 6 and is inaccessible for removal and replacement. Specifically, the forward pad 62 is disposed between the first central layer 14 and the second central layer 18 of the cover assembly 6 and is maintained in a generally fixed position by a portion of the perimeter seal 58, by the V-shaped seal 90 and by the lateral seal 94. In order to vent the space in which the forward pad 62 is disposed, one or more vent holes 47 (one shown) may extend through the fire central layer 14. It should be appreciated that a forward enclosed compartment with an appropriate access opening could be formed in the cover assembly 6 (not shown) such that the forward pad 62 could be removed and reinstalled without damaging the cover assembly 6.

The padding assembly 54 further includes a rear pad 100 which generally interfaces with the rear depression 116 of the base 108 and which in the disclosed embodiment is fluid-based (e.g., uses a fluid as the padding material), and is more preferably a liquid. Flowable materials are the most preferred liquid. Generally, these are materials which resist flowing in response to instantaneously applied pressure, but flow in response to continuously applied pressure. As such, they provide for a desired degree of conforming engagement between the rear pad 100 and a user disposed on the seat cushion system 2 to distribute the user's weight over a large surface area to reduce unit pressure. These flowable materials are relatively viscous. Preferred materials include glycerine and/or water together with viscosity-enhancing agents such as clay, silica and cellulose-based materials. Wax/oil mixtures and/or microbeads can also be used. One fluid/fluid-like substance which is particularly appropriate for padding device applications is available from the assignee of this patent application under the trademark "FLOLITE." Various types of flowable materials are disclosed in U.S. Pat. No. 3,402,411 by Alden Hanson, issued Sep. 24, 1968; U.S. Pat. No. 3,635,849 by Alden Hanson, issued Jan. 18, 1972; U.S. Pat. No. 4,038,762 by Swan, Jr., issued Aug. 2, 1977; U.S. Pat. No. 4,083,127 by Chris Hanson, issued Apr. 11, 1978; U.S. Pat. No. 4,108,928 by Swan, Jr., issued Aug. 22, 1978; U.S. Pat. No. 4,144,658 by Swan, Jr., issued Mar. 20, 1979; U.S. Pat. No. 4,229,546 by Swan, Jr., issued Oct. 21, 1980; U.S. Pat. No. 4,243,754 by Swan, Jr., issued Jan. 6, 1981; U.S. Pat. No. 5,093,138 by Drew et al., issued Mar. 3, 1992; U.S. Pat. No. 5,100,712 by Drew et al., issued Mar 31, 1992 and U.S. Pat. No. 5,204,154 by Drew et al., issued Apr. 20, 1993, the entire disclosures of which are incorporated by a reference herein.

The rear pad 100 is fixably retained between the first central layer 14 and the second central layer 18 Of the cover assembly 6 by a portion of the perimeter seal 58 and the lateral seal 94. A number of flow controllers 104*a–e* are positioned throughout the rear pad 100 and these flow controllers 104 may be formed by attaching the first central layer 14 to the second central layer 18 in a certain configuration (e.g., by heat sealing, by RF welding). In the case of the flow controls 104*a–c*, these are primarily for restricting the flow of flowable material throughout the rear pad 100 so as to reduce the potential for the user "bottoming out" on the base 108 (e.g., a condition where there is no flowable material between supporting surfaces of the base 108 and the user). Flow controllers 104*d–e* also contribute to the flow of flowable material throughout the rear pad 100, but are more specifically in the illustrated position to coincide with the user's two ischial tuberosities such that the user's ischial tuberosities interface with the rear pad 100 in a region having no flowable material therein. Moreover and as discussed above, the base 108 includes the slot 128 in a location which coincides with the user's ischial tuberosities such that in theory, substantially no forces are exerted on the user's ischial tuberosities which would produce pressure sores.

Figure 4A:
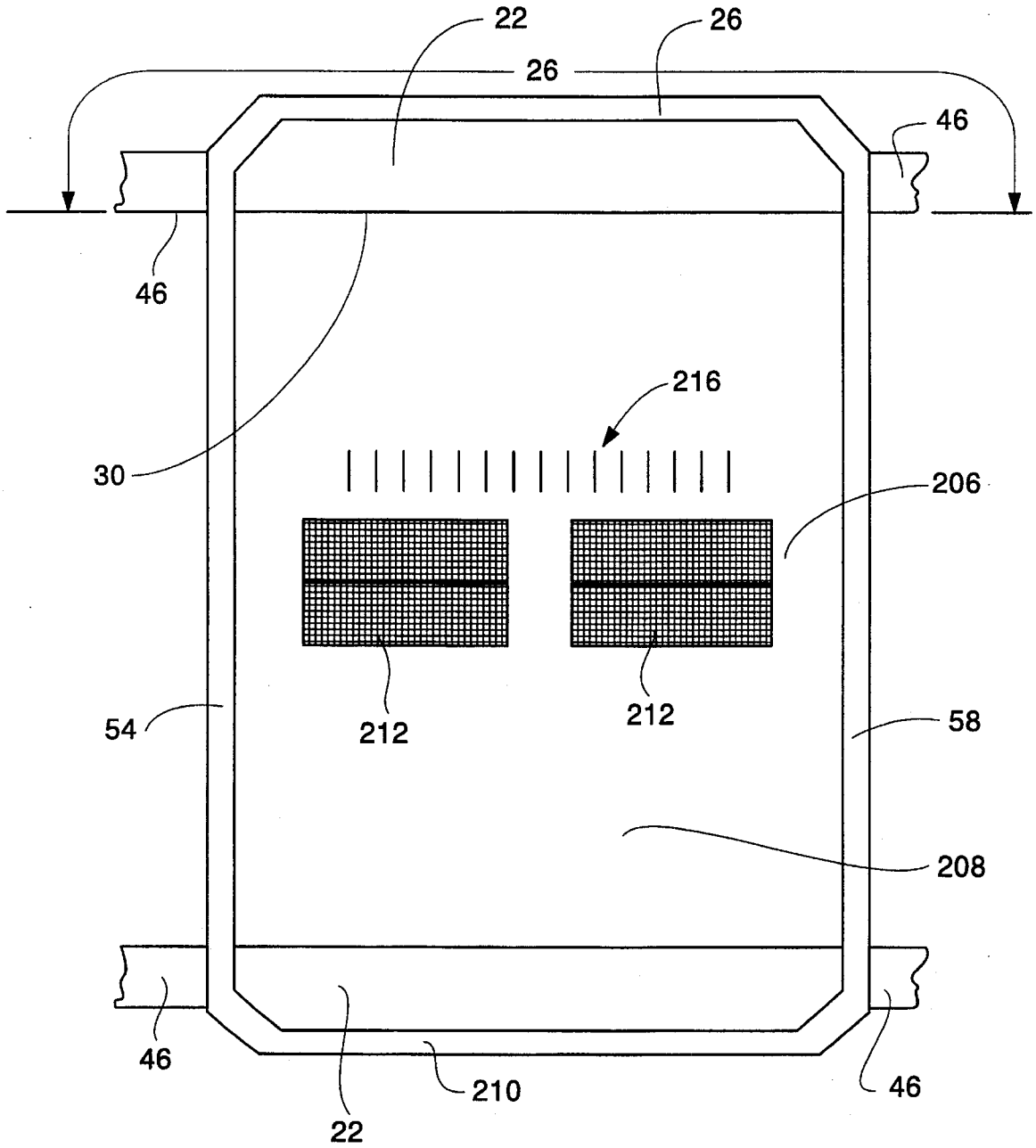
FIG. 4A is a bottom view of the central section of the cover assembly of FIG. 1.

The perimeter seal 58, the V-shaped seal 90, and the lateral seal 94 may each be formed by heat sealing or RF welding the first central layer 14 to the second central layer 18. Since a solid-based structure is used for the forward pad 62, the portion of the perimeter seal 58 disposed about the forward pad 62 need not be continuous as shown, but instead ant intermittent seal may be used (not shown). However, since the rear pad in the illustrated embodiment is fluid-based, the corresponding portion of the perimeter seal 58, as well as the lateral seal 94, must be continuous. It should be noted that a portion of the third central layer 208 of the cover assembly 6 may be incorporated into the perimeter seal 58. This is provided by a strip 210 integrally formed with the main body 206 of the third central layer 208 (FIG. 4A).

Figure 8:
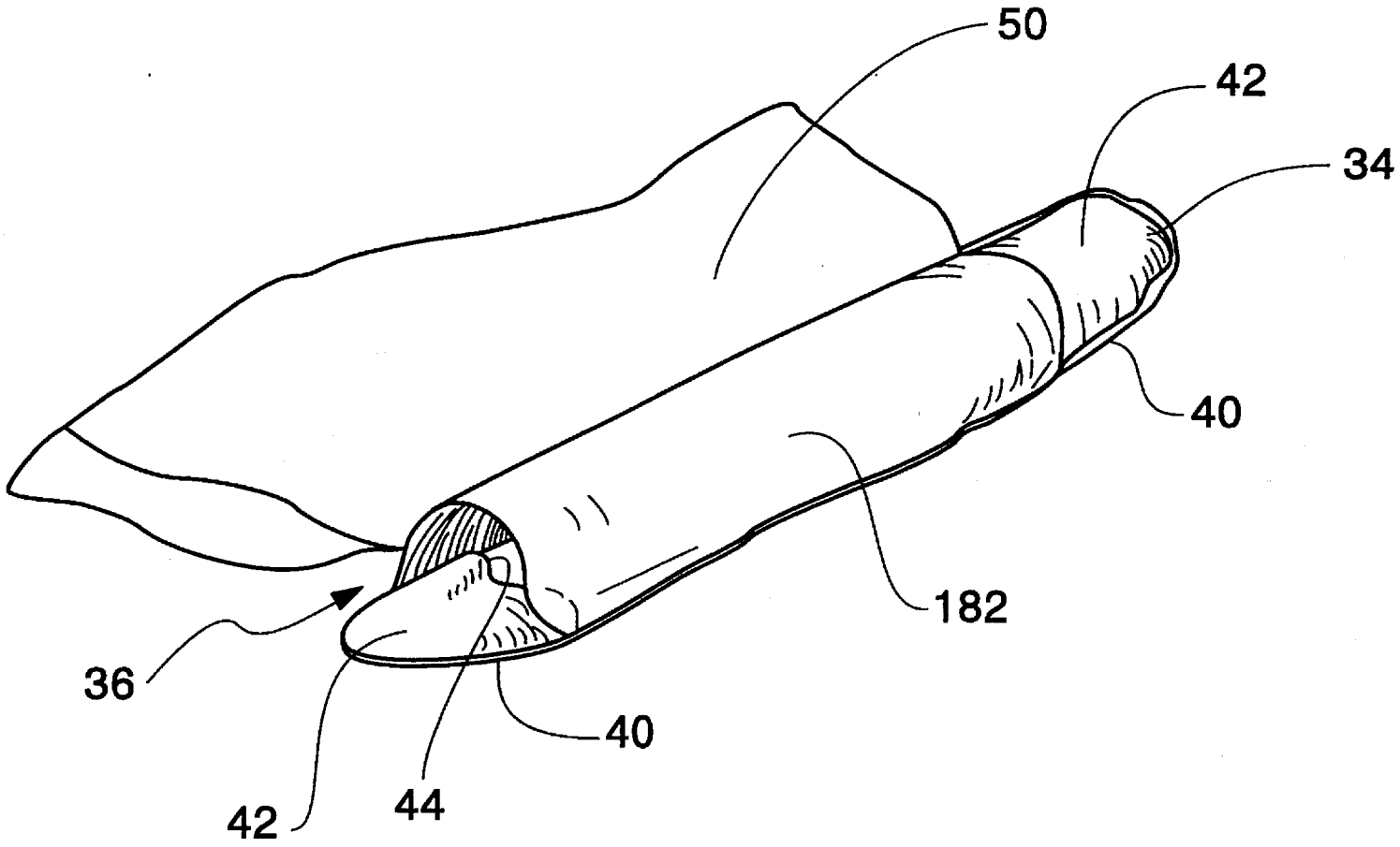
FIG. 8 is a perspective view of one side section of the cover assembly of FIG. 1 illustrating the compartment for the associated side cushion and how the same may be installed therein.

A pair of elongated side cushions 162 are disposed on the two laterally spaced sides of the central cushion assembly 50 (e.g., FIG. 1). Each of these side cushions 162 are removably received/retained within the cover assembly 6, namely its side sections 34. This allows for the individual removal of the side cushions 162 from the cover assembly 6 and to reinstall these same side cushions 162 or to install side cushions 162 having a different profile and/or degree of compressibility (e.g,. by using a "stiffer" or "softer" foam) to change the support characteristics of the side cushions 162. In this regard, the two side sections 34 are interconnected with the central section 10 of the cover assembly 6 and each of these side sections 34 provide a compartment 36 for removably receiving/retaining the associated side cushion 162 (e.g., FIG. 8). Each compartment 36 is defined at least in part by a first side layer 38 (which defines an upper surface for the associated side section 34 of the cover assembly 6) and a pair of longitudinally spaced side flaps 42 attached thereto by a generally U-shaped perimeter seal 40 (e.g., heat sealing, RF welding). The seal 40 may actually be part of the perimeter seal 194 associated with each side section 34 (e.g., FIG. 4A). Note that the side flaps 42 are each not attached to the first side layer 38 along the laterally extending edge 44 such that the two ends of the side cushion 162 may be disposed and retained between the first side layer 38 and the side flaps 42 (e.g., FIG. 4A and FIG. 8).

Figure 4B:
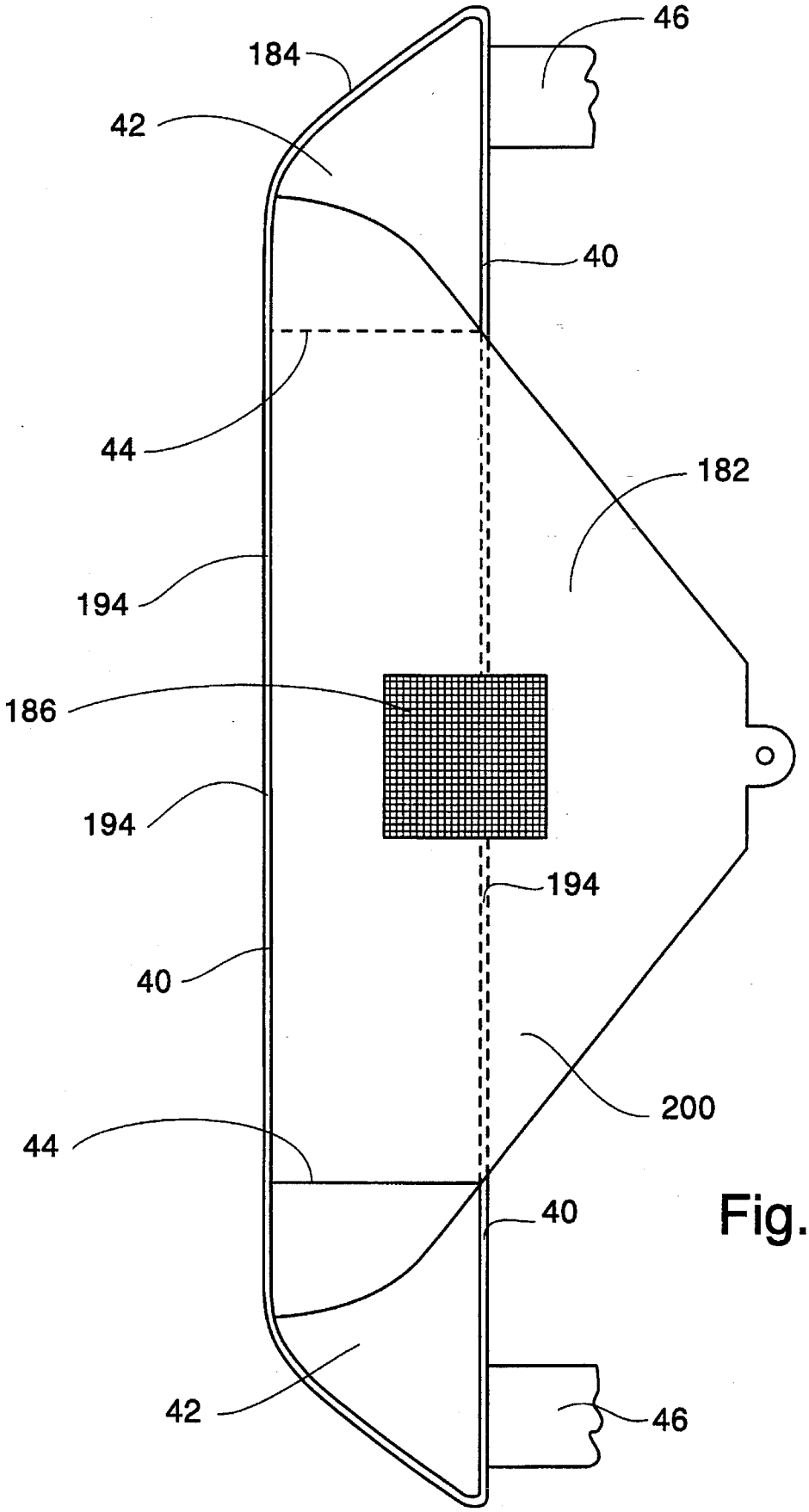
FIG. 4B is a bottom view of one side section of the cover assembly of FIG. 1 and the side cushion positioner associated therewith.

A side cushion positioner 182 also forms a portion of the compartment 36 which retains the associated side cushion 162 within the cover assembly 6. Corresponding portions of each side cushion positioner 182 are attached to the associated first side layer 38 along the perimeter seal 194 associated with each side section 34. A strip 184 may be integrally formed with the main body of each positioner 182 and incorporated into the perimeter seal 194 (FIG. 4B). The portion of the side cushion positioner 182 which is disposed over and encloses the corresponding side cushion 162 overlaps with at least a portion of the associated side flaps 42 but is not attached thereto along the edge 44. As such, this portion of each of the side cushion positioners 182 may be pulled away from the side flaps 42 and the first side layer 38 when positioning the forward and rearward ends of the associated side cushion 162 between the side flaps 42 and the first side layer 38, and when positioning the associated side cushion 162 between the first side layer 38 and the corresponding portion of the side cushion positioner 182 (e.g., FIG. 8).

Figure 9:
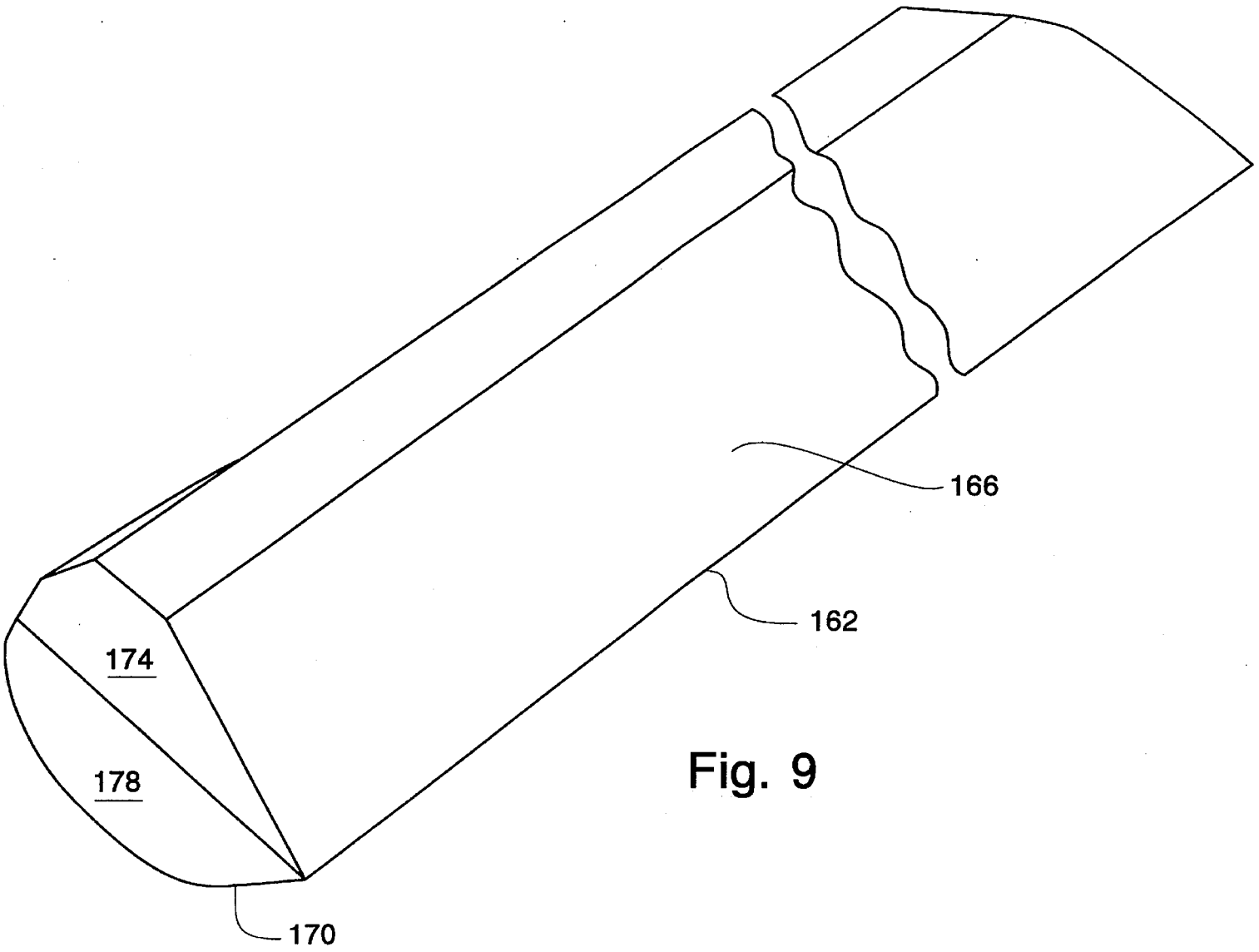
FIG. 9 is a perspective view of a side cushion from the seat cushion system of FIG. 1.
Figure 10:
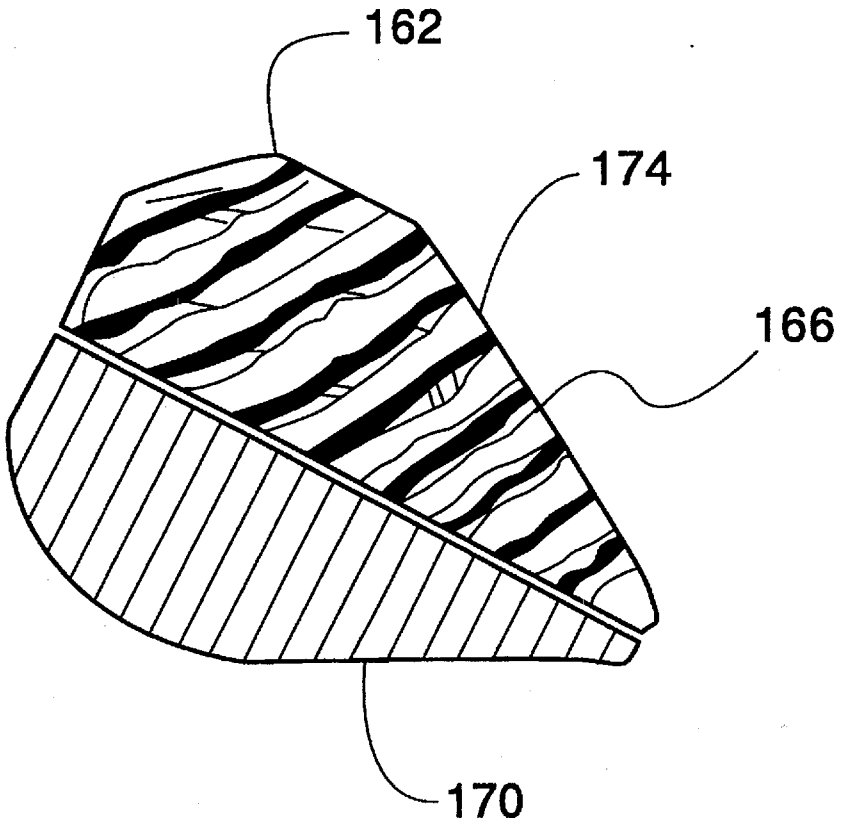
FIG. 10 is lateral cross-sectional view of the side cushion of FIG. 9.
Figure 12:
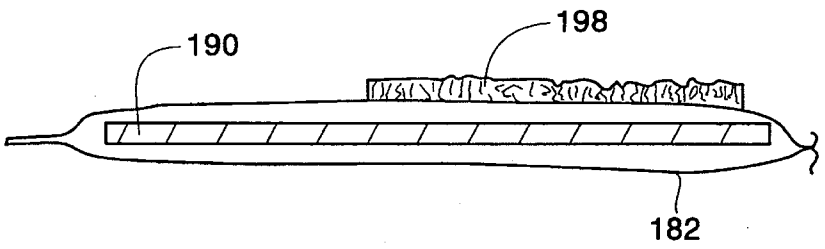
FIG. 12 is a cross-sectional view of the stiffener used by the side cushion positioner from the system of FIG. 1.
Figure 11:
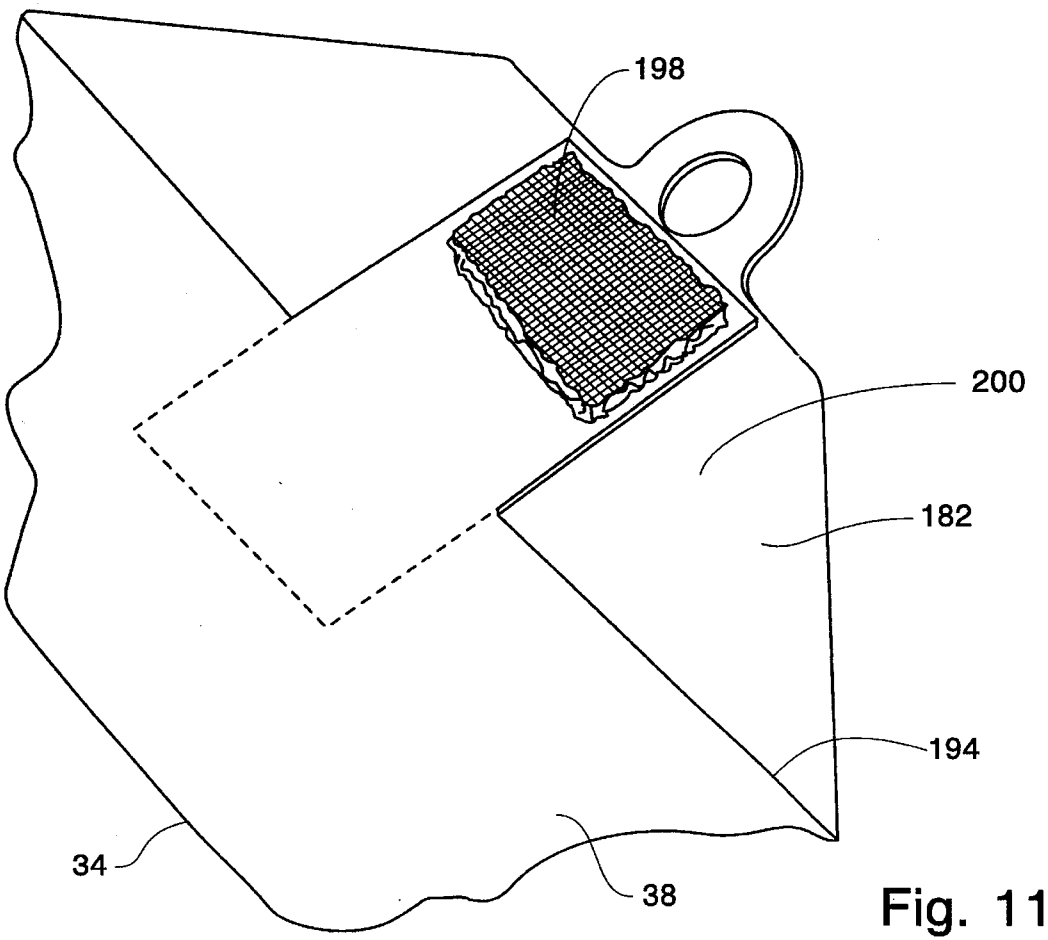
FIG. 11 is a perspective view of the side cushion positioner rotated away from the central cushion assembly.

Each side cushion 162 includes a user engagement surface 166 and a surface 170 which interfaces with the wheelchair seat (e.g., FIGS. 1, 9 and 10). In lateral cross-section, each of the side cushions 162 has a generally wedge-shaped profile in that the user engagement surfaces 166 each generally taper downwardly and inwardly toward a central, longitudinal axis of the seat cushion system 2. This profile may also be characterized as generally teardrop-shaped. The orientation of the user engagement surfaces 166 provides a number of functions. Initially, the orientation of the user engagement surfaces 166 provides some lateral support for the user when disposed on the seat cushion system 2. Moreover, the orientation of the user engagement surfaces 166 may be used to modify the profile of the central cushion assembly 50 and thus the support characteristics of the seat cushion system 2. By having the side cushions 162 disposed at a location such that at least a portion of the user engagement surfaces 166 of the two side cushions 162 are disposed under the central cushion assembly 50, this will provide a "raised" elevation for at least the sides of the central cushion assembly 50 in comparison when the user engagement surfaces 1566 are not so disposed.

Modification of the positioning of the side cushions 162 is provided by its associated side cushion positioner 182 (e.g., FIGS. 2, 4B, 11, 12). The two side cushion positioners 182 are identical such that only one will be described herein. Each positioner includes a body 200 which is generally a sheet-like material and which is integrally formed with the strip 184 (FIG. 4B) which generally coincides with the perimeter seal 194. The body 200 is substantially flexible and pliable, but yet may be more rigid, through its thickness and/or material selection, in relation to the first central layer 14 and second central layer 18 of the cover assembly 6 which also define the padding assembly 54. The body 200 is attached to its associated side section 34 by longitudinally extending portions of the perimeter seal 194 while the generally U-shaped strips 184 of the positioner 182 are incorporated into the "end portions" of the perimeter seal 194. Movement of the positioner 182 within a generally horizontal reference plane (e.g., generally parallel with the lower surface of the central cushion assembly 50) will therefore affect movement of its associated side cushion 162 relative to the central cushion assembly 50.

Each side cushion positioner 182 also includes a central section Velcro® connector 198 which mates with the corresponding positioner Velcro® connector 212 disposed on the lower surface of the third central layer 208 of the cover assembly 6. Each positioner Velcro® connector 212 is generally laterally extending and is sized/oriented so as to provide for sufficient engagement with the central section Velcro® connector 198 when the positioner 182 is in a variety of positions as will be discussed in more detail below (e.g., to maintain engagement therebetween, to limit/restrain movement of the associated positioner 182 relative to the third central layer 208 and thus relative to the central cushion assembly 50).

A stiffener 190 is attached to each associated side cushion positioner 182. The stiffener 190 assists in maintaining the associated side cushion 162 in the desired position once the associated central section Velcro® connector 198 is disposed on the positioner velcro connector 212. In the illustrated embodiment, the central section Velcro® connector 198 is disposed over the associated stiffener 190. Preferably the stiffener 190 is sized to provide the noted function and/or formed from sufficiently rigid materials (e.g., substantially no coplanar flexure). It should be noted that part of the stiffener 190 will be disposed under at least part of the associated side section 34 of the cover assembly 6, and thus under at least part of the associated side section 162, and that part of the stiffener 190 will also be at least partially disposed under the central cushions assembly 50.

The above-described seat cushion assembly 2 allows for independent adjustment of the positioning of each of the side cushions 162 relative to the central cushion assembly 50. As illustrated in FIG. 2, the side cushions 162 may be disposed generally parallel with the edges of the central cushion assembly 50. This parallel condition may be maintained for a variety of widths for the seat cushion system. By disengaging the central section Velcro® connector 198 from its associated positioner Velcro® connector 212, the associated side cushion positioner 182 may be moved along a generally lateral path inward toward the central, longitudinal axis of the seat cushion system 2 to reduce the width of the seat cushion system 2 (and also affect the elevation of the side portion of the central cushion assembly 50 as discussed above), as well as away from this axis to increase the width of the seat cushion system 2. The movable interconnection between the side sections 34 of the cover assembly 6 and the central section 10 of the cover assembly 6, which in the illustrated embodiment is provided by the flexible connectors 46, allows for this type of movement. Whether increasing or decreasing the width of the seat cushion system 2 in the above-described manner, it should be appreciated that one or both of the side cushions 162 may be adjusted in the noted manner. Moreover, the generally parallel orientation between the associated side cushion 162 with the associated side of the central cushion assembly 50 may be maintained. However, other orientations for the side cushions 162 may also be achieved.

Figure 13:
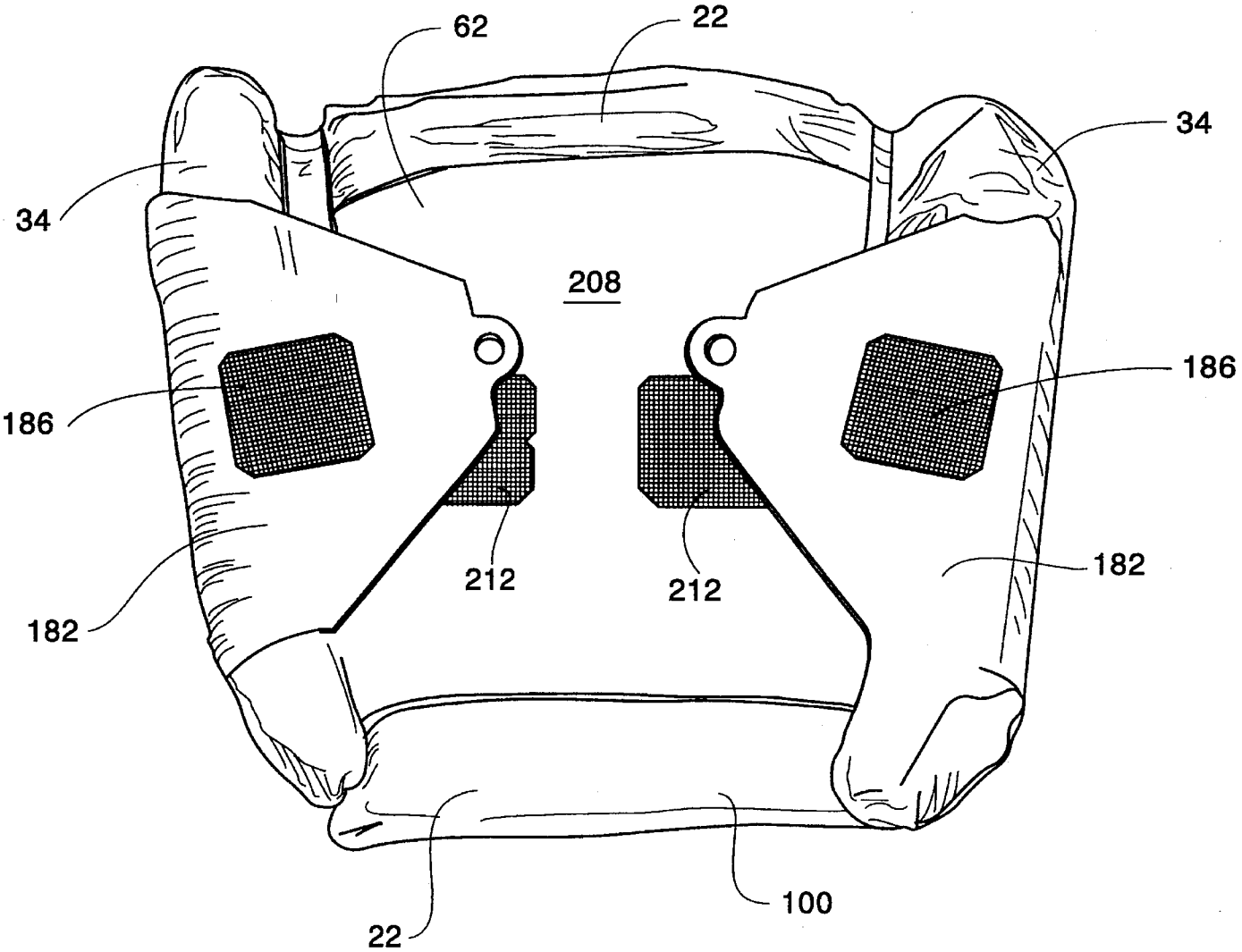
FIG. 13 is a bottom view of the system of FIG. 1 with the side cushion assembly in one type of adjusted position.
Figure 14:
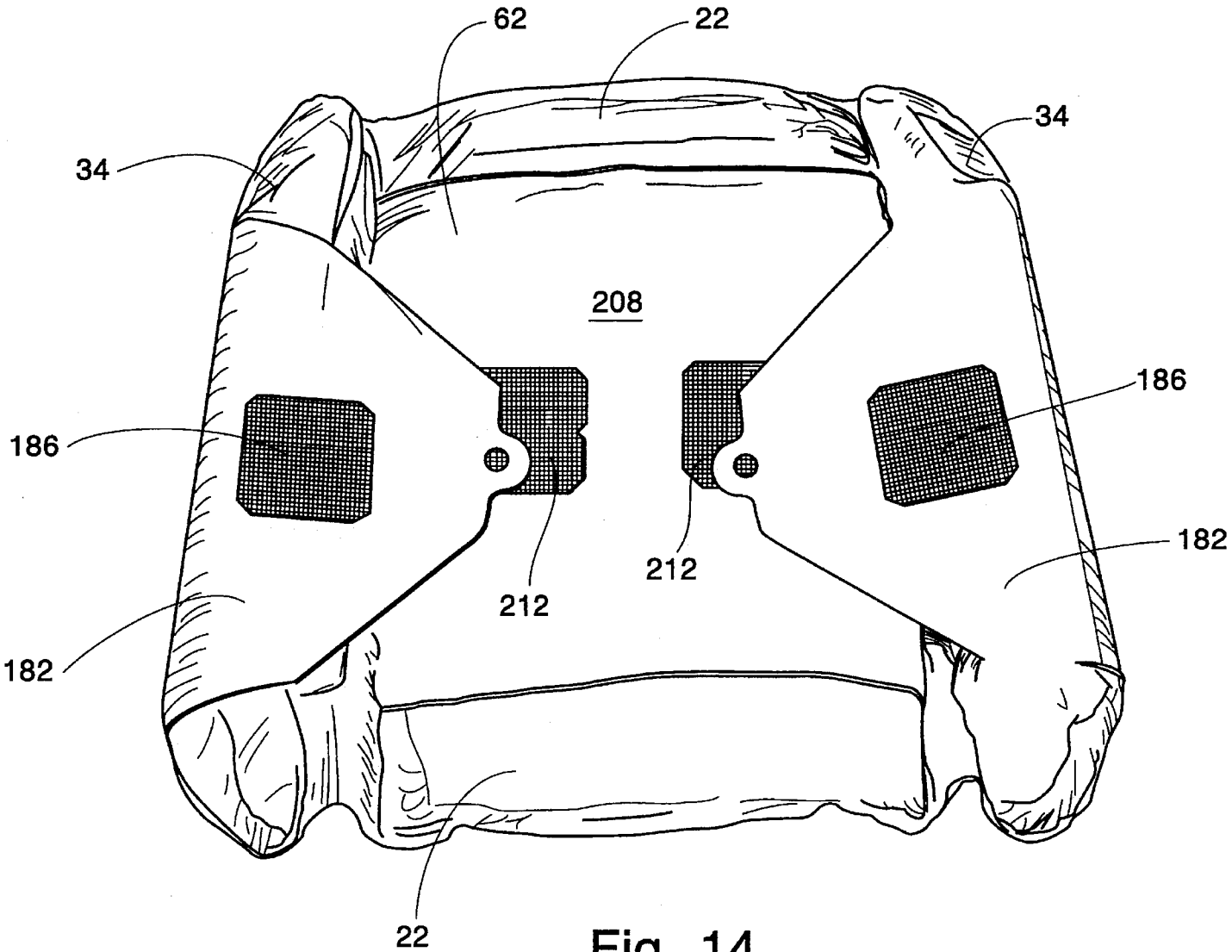
FIG. 14 is a bottom view of the system of FIG. 1 with the side cushion assembly on another type of adjusted position.

As illustrated in FIGS. 13 and 14, the ends of each of the positioners 182 which interface with the positioner Velcro® connectors 212 may also be moved fore or aft such that the associated positioner 182 is disposed at an angle relative to a lateral reference axis. The result is that the associated side cushion 162 is disposed at an angle relative to its associated side of the central cushion assembly 50. When both side cushion positioners 182 are turned to point in an generally "forward" direction as illustrated in FIG. 13, the width between the forward portions of the side cushions 162 is greater than the width of the rearward portions of the side cushions 162. This may also dispose a rearward portion of the user engagement surface 166 more under the associated side of the central cushion assembly 50 than a forward portion of the user engagement surface 166. As can be appreciated, this too (that is in addition to the width between corresponding portions of the side cushions 162) would affect the support characteristics of the seat cushion system 2.

Both side cushion positioners 182 may also be turned to point in an generally "rearward" direction as illustrated in FIG. 14. The result is that the width between the forward portions of the side cushions 162 is less than the width of the rearward portions of the side cushions 162. This may also dispose a forward portion of the user engagement surface 166 more under the associated side of the central cushion assembly 50 than a rearward portion of the user engagement surface 166. As can be appreciated, this too (in addition to the width between corresponding portions of the side cushions 162) would affect the support characteristics of the seat cushion system 2. Again, the movable interconnection between the central section 10 and each of the side sections 34 of the cover assembly 6 allows for these types of adjustments. Moreover, the rigidity of the positioner 182 substantially maintains the position of the associated side cushion 162 relative to the central cushion assembly 50.

The foregoing description of the invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended the claims be construed to include alternative embodiments to the extent permitted by the prior art.

What is claimed is:

1. A seat cushion system, comprising:

a central cushion assembly having first and second laterally spaced sides;

elongated first and second side cushions associated with said first and second sides, respectively, of said central cushion assembly; and first and second means for adjusting a lateral positioning of said first and second side cushions, respectively, relative to said central cushion assembly, wherein said first means for adjusting comprises a first positioner extending from said first side cushion assembly into engagement with a portion of a lower surface of said central cushion assembly and said second means for adjusting comprises a second positioner extending from said second side cushion assembly into engagement with a portion of said lower surface of said central cushion assembly.

2. A cushion system, as claimed in claim 1, wherein:

said central cushion assembly comprises a foam base and a padding assembly disposed over said foam base.

3. A cushion system, as claimed in claim 2, wherein:

an upper surface of said foam base comprises a generally concave, ovally-shaped, laterally disposed depression in an aft portion of said foam base and first and second generally fore-aft extending and laterally spaced leg depressions disposed in a forward portion of said foam base.

4. A cushion system, as claimed in claim 2, wherein:

said padding assembly is fixably retained within a cover, said cover comprising a central compartment for removably receiving said foam base.

5. A cushion system, as claimed in claim 4, wherein:

said padding assembly is fixably retained within said cover, said cover comprising first and second side compartments for removably receiving said first and second side cushions, respectively.

6. A cushion system, as claimed in claim 2, wherein:

a thickness of said foam base is generally reduced progressing from a fore position to an aft position.

7. A cushion system, as claimed in claim 2, wherein:

a lower surface of said foam based comprises at least two laterally spaced and fore-aft extending support rails.

8. A cushion system, as claimed in claim 2, wherein:

said padding assembly comprises a fore portion and an aft portion, said fore portion consisting essentially of a compressible solid-based cushion and said aft portion consisting essentially of a liquid-based cushion.

9. A cushion system, as claimed in claim 6, wherein:

said solid cushion is anatomically-shaped.

10. A cushion system, as claimed in claim 6, wherein:

said solid cushion is generally Y-shaped viewed from an aft position.

11. A cushion system, as claimed in claim 6, wherein:

said liquid cushion comprises a flowable material and wherein a pair of laterally spaced portions contain no flowable material.

12. A cushion system, as claimed in claim 2, wherein:

said padding assembly is fixably retained within a cover, said cover comprising a first and second side compartments for removably receiving said first and second side cushions, respectively.

13. A cushion system, as claimed in claim 1, wherein:

each of said first and second side cushions comprise first and second foam layers.

14. A cushion system, as claimed in claim 1, wherein:

each of said first and second side cushions have a generally teardrop-shaped profile in lateral cross-section.

15. A cushion system, as claimed in claim 1, wherein:

each of said first and second side cushions are generally wedge-shaped, increasing in thickness progressing away from a fore-aft extending reference centerline through said seat cushion system.

16. A cushion system, as claimed in claim 1, wherein:

said first and second positioners comprise substantially rigid first and second members.

17. A cushion system, as claimed in claim 16, wherein:

said first substantially rigid member is disposed below a lower surface of said first side cushion assembly and below said lower surface of said central cushion assembly, and said second substantially rigid member is disposed below a lower surface of said second side cushion assembly and below said lower surface of said central cushion assembly.

18. A cushion system, as claimed in claim 1, wherein:

said first and second positioners each attach to said lower portion of said central cushion assembly along a laterally extending area which is generally disposed at a fore-aft midway of said central cushion assembly.

19. A cushion system, as claimed in claim 1, further comprising:

first and second means for movably interconnecting said first and second side cushions, respectively, with said central cushion assembly, wherein said first and second means for movably interconnecting allow for a change of position of said first and second side cushions, respectively, relative to said central cushion assembly while maintaining the interconnection with said central cushion assembly; and first and second means for fixing a position of said first and second side cushions, respectively, relative to said central cushion assembly.

20. A cushion system, as claimed in claim 19, wherein:

said first and second means for movably interconnecting each comprise first and second, fore-aft spaced, flexible connectors between said first and second side cushions, respectively, and said central cushion assembly.

21. A cushion system, as claimed in claim 19, wherein:

said first and second means for movably interconnecting each consist essentially of first and second, fore-aft spaced, flexible connectors between said first and second side cushions, respectively, and said central cushion assembly.

22. A seat cushion system, comprising:

a cover assembly comprising a central section comprising a central compartment, said cover assembly further comprising first and second side compartments disposed on opposite sides of said central section and each being flexibly interconnected with said central section;

a central cushion assembly having first and second laterally spaced sides and comprising a support base and a padding assembly disposed over an upper surface of said support base, said support base being removably received in said central compartment of said cover assembly;

elongated first and second side cushions associated with said first and second sides, respectively, of said central cushion assembly, said first and second side cushion assemblies being removably received in said first and second side compartments, respectively, of said cover assembly; and first and second side cushion positioners extending from said first and second side compartments, respectively, and detachably engageable with said central section.

23. A cushion system, as claimed in claim 22, wherein:

said padding assembly is fixedly retained within said cover assembly.

24. A cushion system, as claimed in claim 22, wherein:

said first side cushion positioner comprises a first rigid member disposed under both a lower surface of said first side compartment and under a lower surface of said central section, and wherein said second side cushion positioner comprises a second rigid member disposed under both a lower surface of said second side compartment and under a lower surface of said central section.

* * * * *